US005626118A

United States Patent [19]

Sugii

[11] Patent Number: 5,626,118

[45] Date of Patent: May 6, 1997

[54] PISTON VALVE TYPE CARBURETOR

[75] Inventor: Toshio Sugii, Odawara, Japan

[73] Assignee: Mikuni Corporation, Japan

[21] Appl. No.: 560,644

[22] Filed: Nov. 20, 1995

[30] Foreign Application Priority Data

Dec. 13, 1994 [JP] Japan ..... 6-332238

[51] Int. Cl.[6] ..... F02M 7/17; F02M 7/18

[52] U.S. Cl. ..... 123/439

[58] Field of Search ..... 123/437, 438, 123/439; 261/44.3, 44.4, DIG. 67, DIG. 74

[56] References Cited

U.S. PATENT DOCUMENTS

| | | | |
|---|---|---|---|
| 3,974,813 | 8/1976 | Knapp et al. | 123/439 |
| 4,089,311 | 5/1978 | Brettschneider et al. | 123/439 |
| 4,349,877 | 9/1982 | Oyama et al. | 123/439 |
| 4,369,749 | 1/1983 | Sugi | 123/439 |
| 4,563,990 | 1/1986 | Kishida et al. | 123/439 |

FOREIGN PATENT DOCUMENTS 53-16451 6/1978 Japan .

*Primary Examiner*—Willis R. Wolfe

*Attorney, Agent, or Firm*—Lorusso & Loud

[57] ABSTRACT

The position located above the upper surface of fuel in a float chamber is communicated with the position where the sectional area of a suction passage varies or the position in the vicinity of the foregoing position via a negative pressure introduction passage. The intermediate part of the negative pressure passage is opened or closed by a solenoid valve adapted to be controlled by electronic controlling means. An opening/closing rate of a solenoid valve is determined by inputting informations from a temperature sensor sensing the atmospheric temperature as well as a pressure sensor sensing the atmospheric pressure into the electronic controlling means. The float chamber is normally communicated with the atmosphere via an atmosphere passage. As an altitude becomes high more and more, the valve opening time for the negative pressure introduction passage is elongated and the differential pressure between the float chamber and the suction passage is reduced, causing a quantity of ejected fuel to be reduced. In addition, as the atmospheric temperature becomes high more and more, the valve opening time for the negative pressure introduction passage is elongated and the differential pressure between the float chamber and the suction chamber is reduced, and a quantity of ejected fuel is reduced so that the air fuel ratio is corrected by adjusting a quantity of fuel to be ejected.

14 Claims, 4 Drawing Sheets

PISTON VALVE TYPE CARBURETOR

BACKGROUND OF THE INVENTION

1. Field of the Invention

The present invention relates to a piston valve type carburetor which assures that air fuel ratio can automatically be corrected according to the variation of an altitude as well as the variation of a temperature.

2. Description of the Related Art

For example, a snow mobile is used at an altitude of zero to 3000 m for a period of time of a coldest season to the early part of Spring under an environment that an atmospheric pressure and an atmospheric temperature widely vary. As the atmospheric pressure and the atmospheric temperature widely vary in that way, an air density largely varies with the result that the air fuel ratio of a carburetor largely varies.

Generally, a conventional carburetor can not correspond to the variation of an air fuel ratio when an altitude and an atmospheric pressure largely vary. For this reason, a component such as a main jet or the like is exchanged with another one corresponding to operational conditions such as an altitude, an atmospheric temperature or the like so as to correct the deviation of an air fuel ratio. However, a problem is such that an exchanging operation takes long time.

SUMMARY OF THE INVENTION

The present invention has been made in consideration of the aforementioned background.

An object of the present invention is to provide a piston valve type carburetor which assures that an air fuel ratio can automatically be corrected regardless of the variation of an altitude as well as the variation of an atmospheric temperature without any necessity for exchanging a main jet or the like with another one.

According to one aspect of the present invention, there is provided a piston valve type carburetor including a float chamber having fuel stored therein, a piston valve adapted to be directly actuated to variably change a sectional area of a suction passage, and a jet needle secured to the piston valve to adjust a quantity of fuel to be ejected from a float chamber to the suction passage, wherein the piston valve type carburetor comprises an atmospheric passage by way of which the float chamber is normally communicated with atmosphere, a negative pressure introduction passage of which one end is opened at the position of the suction passage or the position in the vicinity of the suction passage of which sectional area is varied by the piston valve and of which other end is opened at the position located above a fuel surface of the fuel chamber, opening/closing means for opening or closing the intermediate part of the negative pressure introduction passage, a temperature sensor for sensing the temperature of atmosphere, a pressure sensor for sensing the atmospheric pressure, and electronical controlling means for controlling opening or closing of the opening/closing means in response to informations from the temperature sensor and the pressure sensor.

When it is assumed that the composite pressure composed of the atmospheric pressure introduced via the atmospheric passage and the negative pressure of the suction passage introduced from the negative pressure introduction passage opened or closed by the opening/closing means is represented as pressure in the float chamber, an opening degree rate of the negative pressure introduction passage by the opening/closing means is increased as the atmospheric pressure sensed by the pressure sensor is reduced more and more, and the opening degree rate of the negative pressure passage by the opening/closing means is increased as the atmospheric temperature sensed by the temperature sensor is increased more and more.

In addition, the piston valve type carburetor includes a through system air passage and through system opening/closing means for opening or closing the intermediate part of the through system air passage, and an opening degree rate of the through air passage by the through system opening/closing means is increased as the atmospheric pressure sensed by the pressure sensor is reduced more and more, and the opening degree rate of the through air passage by the through system opening/closing means is increased as the atmospheric temperature sensed by the temperature sensor is increased more and more.

It is preferable that the opening/closing means is a solenoid valve of which driving is achieved in conformity with a fixed period.

Otherwise, the opening/closing means is a solenoid valve of which driving is achieved in conformity with the period synchronized with an engine speed.

Alternatively, the opening/closing means is a solenoid valve of which driving is normally achieved in conformity with a fixed period, and this fixed driving period is slightly elongated or shortened at the time of a certain specific engine speed.

According to other aspect of the present invention, there is provided a piston valve type carburetor including a float chamber having fuel stored therein, a piston valve adapted to be directly actuated to variably change a sectional area of a suction passage, and a jet needle secured to the piston valve to adjust a quantity of fuel to be ejected from the float chamber to the suction passage, wherein the piston valve type carburetor comprises an atmospheric passage by way of which the float chamber is normally communicated with atmosphere, opening/closing means for opening or closing the intermediate part of the atmospheric passage, a negative pressure introduction passage of which one end is opened at the position of the suction passage or the position in the vicinity of the suction passage of which sectional area is varied by the piston valve and of which other end is opened at the position located at the position above a fuel surface of the float chamber, a temperature sensor for sensing the temperature of atmosphere, a pressure sensor for sensing the atmospheric pressure, and electronical controlling means for controlling opening or closing of the opening/closing means in response to informations from the temperature sensor and the pressure sensor.

Similarly, when it is assumed that the composite pressure composed of the atmospheric pressure introduced via the atmospheric passage opened or closed by the opening/closing means and the negative pressure of the suction passage introduced from the negative pressure introduction passage is represented as pressure in the float chamber, an opening rate of an atmospheric pressure introduction passage by the opening/closing means is reduced as the atmospheric pressure sensed by the pressure sensor is reduced more and more, and the opening degree rate of the atmospheric pressure introduction passage by the opening/closing means is reduced as the atmospheric temperature sensed by the temperature sensor is increased more and more.

In addition, the piston valve type carburetor includes a through system air passage and through system opening/closing means for opening or closing the intermediate part of the through system air passage, and an opening degree rate of the through air passage by the through system opening/closing means is increased as the atmospheric pressure sensed by the pressure sensor is reduced more and more, and the opening degree rate of the through system air passage by the through system opening/closing means is increased as the atmospheric temperature sensed by the temperature sensor is increased more and more.

With this construction, as the altitude becomes high more and more, i.e., the atmospheric pressure becomes low more and more, the valve opening rate of the negative pressure introduction passage is increased, a quantity of intake of the suction passage negative pressure into the float chamber is increased, the differential pressure between the float chamber and the suction passage is reduced, causing a quantity of fuel ejection to be reduced. As the atmospheric temperature becomes high more end more, the valve opening rate of the negative pressure introduction passage is increased, a quantity of intake of the suction passage negative pressure into the float chamber is increased, the differential pressure between the float chamber and the suction passage is reduced, causing a quantity of fuel ejection to be reduced. In such manner, the differential pressure between the float chamber and the Venturi portion of the suction passage is varied corresponding to the variation of the atmospheric pressure and the atmospheric temperature, whereby the air furl ratio can be corrected by adjusting a quantity of fuel ejection. Thus, although a vehicle runs at what altitude or in the region having what temperature, the air fuel ratio can adequately corrected.

Other objects, features and advantages of the present invention will become apparent from reading of the following description which has been made in conjunction of the accompanying drawings.

DESCRIPTION OF THE PREFERRED EMBODIMENTS

The present invention will now be described in detail hereinafter with reference to the accompanied drawings which illustrate preferred embodiments thereof.

First Embodiment

Figure 1:
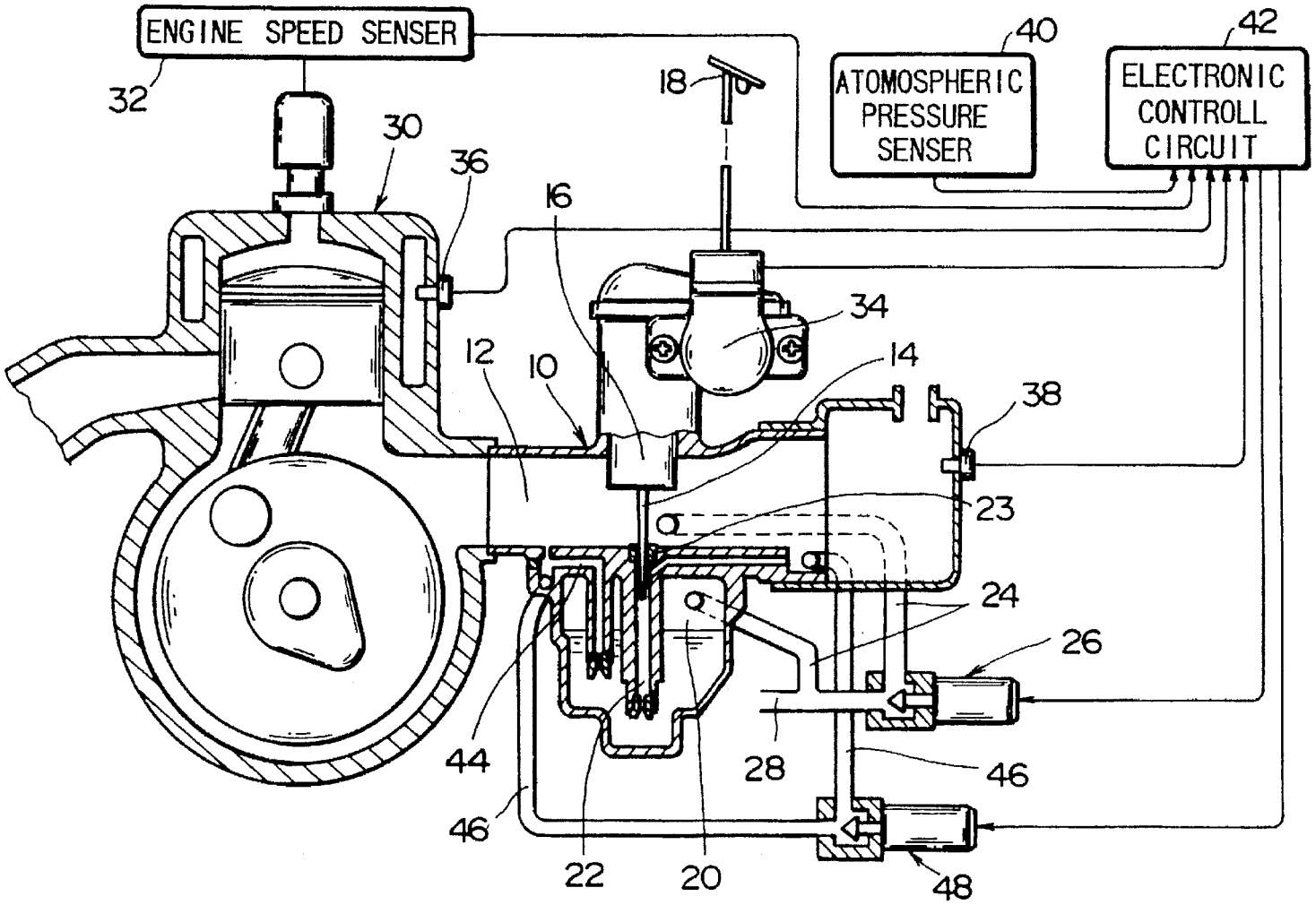
FIG. 1 is an illustrative view of a piston valve type carburetor constructed in accordance with a first embodiment of the present invention.

FIG. 1 is an illustrative view which shows the structure of a piston valve type carburetor constructed in accordance with a first embodiment of the present invention. A suction passage 12 is formed in a housing 10 of the carburetor, and a sectional area of the suction passage 12 at the intermediate part of the latter is changeable by a piston valve 16 having a jet needle 14 attached thereto. The piston valve 16 is driven directly by a driver. For example, the piston valve 16 is driven in operative association with an accelerator 18. The housing 10 of the carburetor includes a float chamber 20 in which fuel is stored, and main fuel is ejected into the suction passage 12 via a main fuel passage 22 and a main jet 23 from the float chamber 20. A quantity of ejection of the main fuel is determined by a sectional area of the passage at the insert location where the jet needle 14 is inserted into a measuring portion of the piston valve 16 and a differential pressure between the pressure appearing at the position of the suction passage 12 where the sectional area of the passage is changed by the piston valve 16 (hereinafter referred to as "Venturi portion") and the pressure in the float chamber 20.

Figure 2:
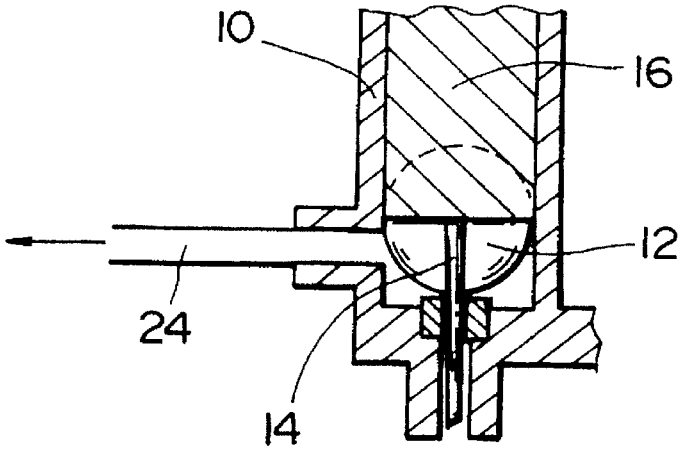
FIG. 2 is a sectional view of essential components.

A negative pressure introduction passage 24 of which one end is opened at the Venturi portion or the proximity of the same is disposed, and the other end of the negative pressure introduction passage 24 is communicated with the part located above the upper surface of fuel in the float chamber 20. As shown in FIG. 2, the position where the negative pressure introduction passage 24 is opened to the suction passage 12 is located such that when the piston valve 16 opens the suction passage 12 to a certain opening degree or more, the negative pressure introduction passage 24 is communicated with the suction passage 12, and until the foregoing opening degree is reached, the communication of the suction passage 12 with the negative pressure introduction passage 24 is interrupted so as not to allow negative pressure at the Venturi portion of the suction passage 12 (hereinafter referred to as "Venturi negative pressure") to be introduced into the negative pressure introduction passage 24. This is intended for the purpose of correcting the air fuel ratio at the time when a vehicle (not shown) is brought in the running state that the passage of the main fuel system is used.

A solenoid valve 26 serving as opening/closing means for opening and closing the negative pressure introduction passage 24 is disposed at the intermediate part of the negative pressure introduction passage 24. The negative pressure introduction passage 24 is communicated with an atmospheric passage 28 at the intermediate position between the position opened or closed by the solenoid valve 26 and the float chamber 20. Thus, atmosphere is normally introduced into the float chamber 20 via the atmosphere passage 28. In the case that the negative pressure introduction passage 24 is opened by the solenoid valve 26, the Venturi negative pressure in the suction passage 12 is introduced into the float chamber 20, and moreover, the composite pressure composed of the atmospheric pressure and a part of the Venturi negative pressure in the suction passage 12 is introduced into the float chamber 20.

According to the present invention, various kinds of sensors are arranged around the housing 10 of the carburetor and an engine 20. For example, an engine speed sensor 32 for sensing an engine speed, a valve opening/closing degree sensor 34 for sensing the opened degree of the piston valve 16, an engine coolant temperature sensor 36 for detecting engine coolant, a temperature sensor 38 for sensing the temperature of sucked air sucked in the suction passage 12, i.e., the temperature of environmental air and an atmospheric pressure sensor for sensing the atmospheric pressure are arranged.

The engine speed sensor 32, the valve opening/closing degree sensor 34, the coolant temperature sensor 36 and the atmospheric pressure sensor 40 are electrically connected to an electronic control circuit 42 into which informations from the respective sensors are inputted. In addition, the electronic control circuit 42 is electrically connected to the solenoid valve 26 which is actuated in response to each of the informations of the respective sensors.

The opening or closing operation of the solenoid valve 26 to be performed by the electronic controlling circuit 42 involves a valve opened state and a valve closed state of the negative pressure introduction passage 24 per one pulse while, e.g., a period is kept immovable, and a valve opening rate and a valve closing rate are controlled by the electronic controlling circuit 42 (such control is hereinafter referred to as "duty control").

A through system fuel passage 44 is formed in the housing 10 of the carburetor, and the through system air passage 46 is formed to communicate the though system fuel passage 44 with the upstream side of the suction passage 12. A through system solenoid valve 48 to be opened or closed by the electronic control circuit 42 is disposed at the intermediate position of the through system air passage 46.

Figure 3:
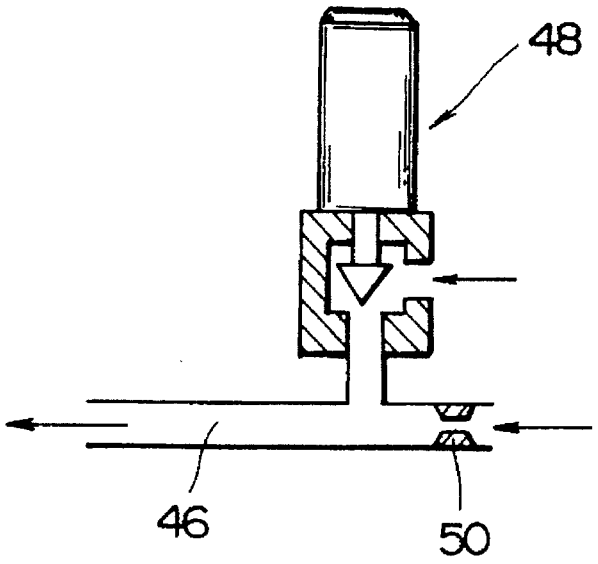
FIG. 3 is an illustrative view which shows an intake portion of a through air passage.

As shown in FIG. 3, the through air passage 46 may includes two air intake ports, one of them being normally communicated with atmosphere via a throttle 50, and the other one including the through system solenoid valve 48.

Next, operation of the piston valve type carburetor will be descried below.

With respect to the piston valve type carburetor, a quantity of fuel ejection into the suction passage from the float chamber is determined by the differential pressure between the Venturi negative pressure and the pressure in the float chamber. The float chamber of a conventional carburetor is kept opened to atmosphere.

In contrast with the conventional carburetor, according to the present invention, the Venturi negative pressure in the suction passage 12 is brought in the interior of the float chamber 20 via the negative pressure introduction passage 24, and controlling for opening and closing of the negative pressure introduction passage 24 is achieved by the solenoid valve 26. Duty controlling of the solenoid valve 25 is achieved by inputting informations from the engine speed sensor 32, the coolant temperature sensor 36, the temperature sensor 38 and the atmospheric pressure sensor 40 into the electronic controlling circuit 42 and calculating these informations in the electronic control circuit 42.

Here, when it is assumed that a rate of opening the negative pressure passage 24 per one period is referred to as "a duty ratio", in the case that the duty ratio is 0%, the negative pressure introduction passage 24 is kept closed so that the venturi negative pressure is not introduced into the float chamber 20. On the other hand, atmosphere is introduced into the float chamber 20 via the atmosphere passage 28 so that the pressure in the float chamber 20 becomes an atmospheric pressure, whereby the piston valve type carburetor functions in the same manner as the conventional ordinary carburetor.

On the other hand, in such a state that the solenoid valve 25 is duty-controlled and the duty ratio does not assume 0%, a part of the Venturi negative pressure is introduced into the float chamber 20 via the negative pressure introduction passage 24. For this reason, the pressure of the float chamber 20 becomes a composite pressure composed of the atmospheric pressure and a part of the Venturi negative pressure, causing it to become lower than the atmospheric pressure. As a result, the differential pressure between the pressure in the Venturi portion of the suction passage 12 and the pressure in the float chamber 20 becomes small and a quantity of fuel to be ejected becomes small. Since a quantity of introduction of the Venturi negative pressure into the float chamber 20 increases as the duty ratio is enlarged more and more, a quantity of fuel ejection from the float chamber 20 to the suction passage 12 is reduced.

It has been hitherto known with respect to a carburetor that when an altitude becomes high (atmospheric pressure becomes low) or the atmospheric temperature becomes high, the air density is reduced and the air fuel ratio becomes excessively dense. In view of the foregoing fact, according to the present invention, the duty ratio is controlled corresponding to the variation of the air density. Specifically, in the case that an altitude is low (the atmospheric pressure is relatively high), the duty ratio is reduced and a quantity of fuel to be ejected is increased. On the contrary, in the case that an altitude is high (the atmospheric pressure is relatively low), the duty ratio is increased and a quantity of fuel to be ejected is reduced. In addition, in the case that the atmospheric temperature is low, the duty ratio is reduced and a quantity of fuel to be ejected is increased. On the contrary, in the case that the atmospheric temperature is low, the duty rate is reduced and a quantity of fuel to be ejected is increased, and in the case that the atmospheric temperature is high, the duty ratio is increased and a quantity of fuel to be ejected is reduced.

In such manner, as an altitude is increased or the atmospheric temperature is increased a quantity of fuel to be ejected can be reduced, and it can be prevented that the air fuel ratio becomes excessively dense. In such manner, by controlling the duty ratio of the solenoid valve 26 which opens or closes the negative pressure introduction passage 24 corresponding to the variation of the atmospheric pressure and the atmospheric temperature, the differential pressure between the Venturi portion of the suction passage 12 and the float chamber 20 is adjusted as desired. Thus, although the vehicle runs at what altitude or the vehicle runs in what region, the air fuel ratio can adequately be corrected, resulting in properties of drivability being improved.

Incidentally, the duty ratio can be varied not only depending on the atmospheric pressure and the temperature of the sucked air but also depending on the engine seed, the opening degree of the piston valve 16 and the coolant temperature.

In addition, when the sectional area of the through system air passage 46 communicated with the through system fuel passage 44 is duty-controlled by the through system solenoid valve 48, the air fuel ratio can be corrected in more detail corresponding to the variation of an altitude and an atmospheric temperature over the whole operational range.

At this time, with respect to the through system solenoid valve 48, in the case that an altitude is low (atmospheric pressure is relatively high), the duty ratio is reduced and a quantity of fuel to be ejected is increased. On the contrary, in the case that an altitude is high (atmospheric pressure is relatively low), the duty ratio is increased and a quantity of fuel to be ejected is reduced. In the case that environmental temperature is low, the duty ratio is reduced and a quantity of fuel to be ejected is increased. On the contrary, in the case that the environmental temperature is high, the duty ratio is increased and a quantity of fuel to be ejected is reduced.

Figure 4:
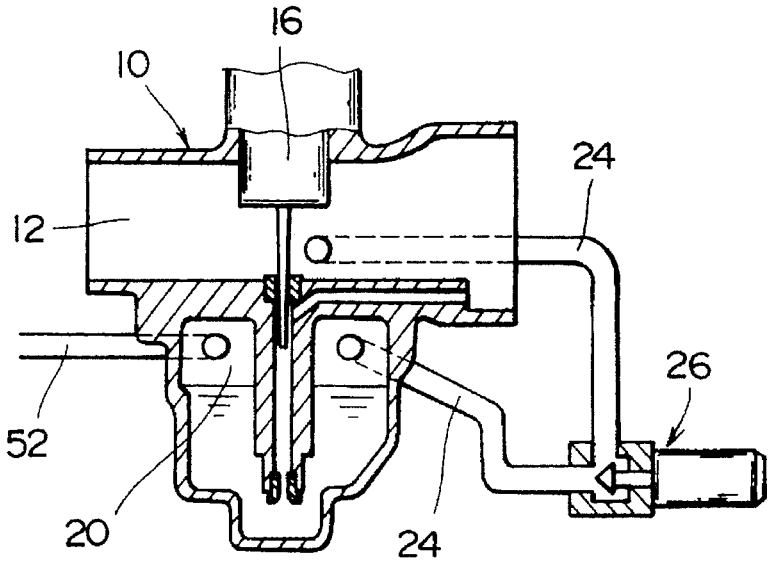
FIG. 4 is a fragmentary illustrative view which shows an essential part of the piston valve type carburetor constructed in accordance with a second embodiment of the present invention.

Referring to FIG. 1, with respect to the negative pressure introduction passage 24, the atmospheric passage 28 is communicated at the intermediate part between the position of the solenoid valve 26 and the float chamber 20. In stead of the aforementioned structure, however, as shown in FIG. 4, an atmospheric passage 52 communicating with atmosphere may be communicated to the region located above the fuel surface in the float chamber 20 while the negative pressure introduction passage 24 is not communicated with the atmospheric passage. With the structure as shown in FIG. 4, the piston valve type carburetor functions in the same manner as the structure shown in FIG. 1.

Incidentally, it is not necessary that opening/closing operation of the solenoid valve 26 is performed with a fixed period but it may function in conformity with, e.g., the period synchronized with the period of the engine speed. In addition, the solenoid valve 26 may be driven in conformity with the period synchronized with a specific engine speed, although the solenoid valve 26 is normally driven in conformity with a fixed period. In such manner, it is possible that the period of the solenoid valve 26 assumes a fixed or variable value. In addition, it is possible that the period of the through system solenoid value 48 assumes a fixed or variable value.

Second Embodiment

A second embodiment of the present invention will be described below with reference to the drawings.

Figure 5:
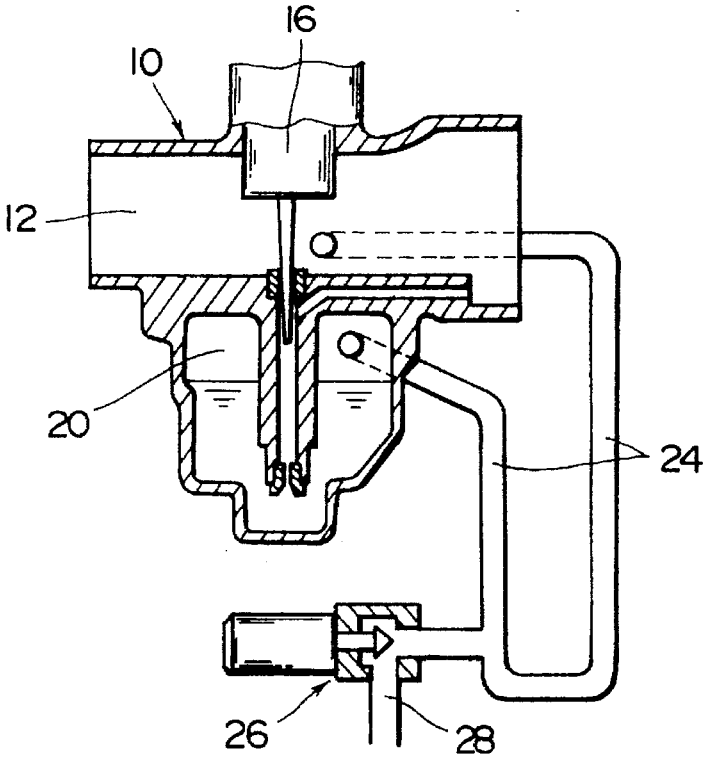
FIG. 5 is a fragmentary sectional view which shows the structure of a piston valve type carburetor constructed in accordance with a modified embodiment of the present invention.

FIG. 5 is a fragmentary sectional view which shows the structure of a piston valve type carburetor constructed in accordance with the second embodiment of the present invention. Same components as those in the first embodiment are represented by same reference numerals. In the first embodiment, the solenoid valve 26 is disposed at the intermediate position of the negative pressure introduction passage 24 to open or close the same. A different point of the second embodiment from the first embodiment consists in that a solenoid valve 26 is disposed on the atmospheric passage side. Specifically, as shown in FIG. 5, any intermediate part of the negative pressure introduction passage 24 is not interrupted by the solenoid valve 26 and an atmospheric passage 28 is united with the negative pressure introduction passage 24 at the intermediate part of the latter, and the intermediate part of the atmospheric passage 28 is opened or closed by the solenoid valve 26.

Referring to FIG. 5, Venturi negative pressure of the suction passage 12 is normally introduced into a float chamber 20, and an atmospheric passage 28 is opened or closed by the solenoid valve 26. Thus, in the case that a duty ratio of the solenoid valve 26 for opening or closing the atmospheric passage 28 is small, a degree of introduction of the atmospheric pressure into the float chamber 20 becomes small, and the differential pressure between the float chamber 20 and a Venturi portion of the suction passage 12 becomes small, causing a quantity of fuel to be ejected to be reduced. On the contrary, in the case that the duty ratio of the solenoid valve 26 is large, a degree of introduction of the atmosphere pressure into the float chamber 20 becomes large, the differential pressure between the float chamber and the Venturi portion becomes large, and a quantity of fuel to be ejected becomes large.

Accordingly, in the case that an altitude is low (the atmospheric pressure is relatively high), the duty ratio is increased, causing a quality of fuel to be ejected to be increased. On the contrary, in the case that an altitude is high (the atmospheric pressure is relatively low), the duty ratio is reduced, causing a quantity of fuel to be ejected to be reduced. In the case that the atmospheric temperature is low, the duty ratio is increased and a quantity of fuel to be ejected is increased. On the contrary, in the case that the atmospheric temperature is high, the duty ratio is reduced and a quantity of fuel to be ejected is reduced.

In such manner, as the altitude becomes higher or the atmospheric temperature becomes higher, a quantity of fuel to be ejected can be reduced, and it can be prevented that an air fuel ratio is excessively dense. In such manner, by controlling the duty ratio of the solenoid valve which opens or closes the negative pressure introduction passages 24 corresponding to the variation of the atmospheric pressure and the atmospheric temperature, the differential pressure between the Venturi portion of the suction passage 12 and the float chamber 20 can be adjusted as desired. Thus, although the vehicle runs at what altitude and in what region, the air fuel ratio can adequately be corrected.

Figure 6:
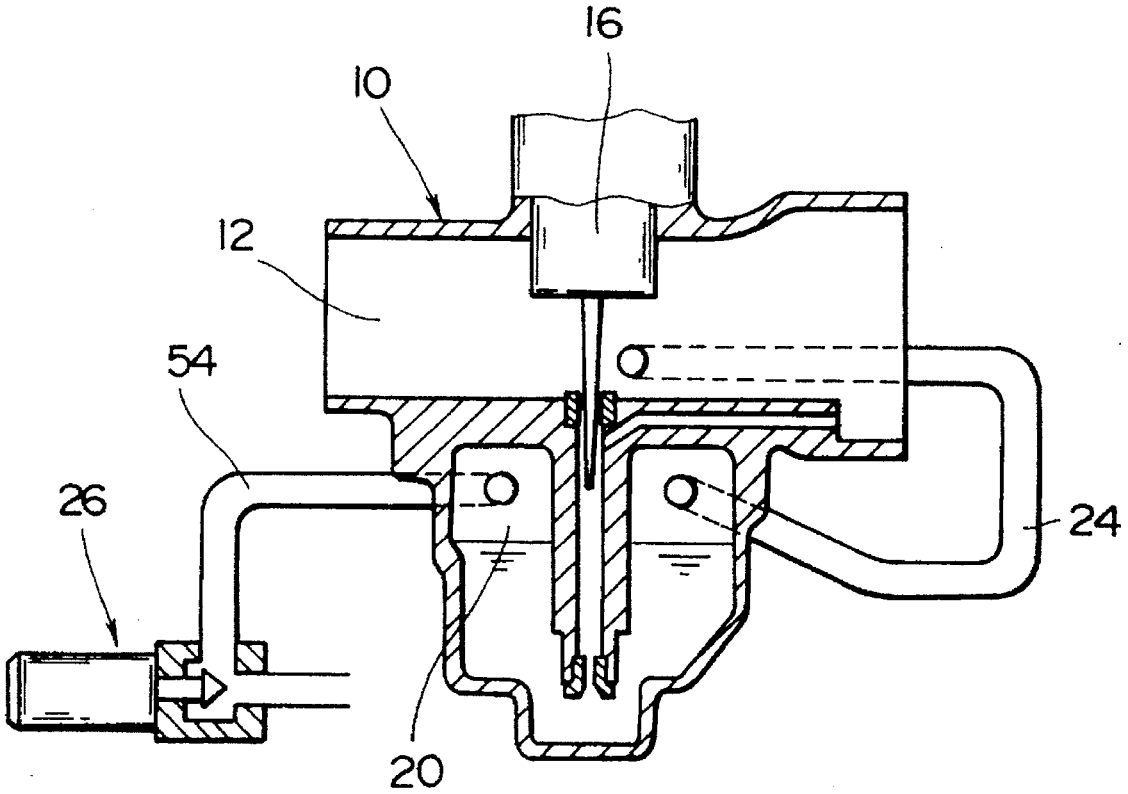
FIG. 6 is a fragmentary sectional view which shows an essential part of the piston valve type carburetor constructed in accordance with another modified embodiment of the present invention.

Referring to FIG. 5, the piston valve type carburetor is constructed such that the atmospheric passage 28 communicating with the intermediate part of the negative pressure introduction passage 24 is opened or closed by the solenoid valve 26. Instead of the foregoing structure, however, as shown in FIG. 6, an atmospheric passage 54 communicating with atmosphere may be communicated directly with a part of the float chamber 20 located above the fuel surface so as to allow the atmospheric passage 54 to be opened or closed by a solenoid valve 54 while the negative pressure introduction passage 24 is not communicated with the atmospheric passage 54. The piston valve type carburetor constructed as shown in FIG. 6 functions in the same manner as that constructed as shown in FIG. 5.

While the present invention has been described above with respect to two preferred embodiments thereof, it should of course be understood that the present invention should not be limited only to these embodiments but various change or modification may be made without departure from the scope of the present invention as defined by the appended claims.

What is claimed is:

1. A piston valve type carburetor including a float chamber having fuel stored therein, a piston valve adapted to be directly actuated to variably change a sectional area of a suction passage, and a jet needle secured to said piston valve to adjust a quantity of fuel to be ejected from a float chamber to said suction passage, comprising;

an atmospheric passage by way of which said float chamber is normally communicated with atmosphere, a negative pressure introduction passage of which one end is opened at the position of said suction passage or the position in the vicinity of said suction passage of which sectional area is varied by said piston valve and of which other end is opened at the position located above a fuel surface of said float chamber, opening/closing means for opening or closing the intermediate part of said negative pressure introduction passage, a temperature sensor for sensing the temperature of atmosphere, a pressure sensor for sensing the atmospheric pressure, and electronical controlling means for controlling opening or closing of said opening/closing means in response to informations from said temperature sensor and said pressure sensor.

2. The piston valve type carburetor as claimed in claim 1, wherein when it is assumed that the composite pressure composed of the atmospheric pressure introduced via said atmospheric passage and the negative pressure of said suction passage introduced from said negative pressure introduction passage opened or closed by said opening/closing means is represented as pressure in said float chamber, an opening degree rate of said negative pressure introduction passage by said opening/closing means is increased as the atmospheric pressure sensed by said pressure sensor is reduced more and more, and said opening degree rate of said negative pressure passage by said opening/closing means is increased as the atmospheric temperature sensed by said temperature sensor is increased more and more.

3. The piston valve type carburetor as claimed in claim 1, wherein said piston valve type carburetor includes a through system air passage and through system opening/closing means for opening or closing the intermediate part of said through system air passage, and an opening degree rate of said through air passage by said through system opening/closing means is increased as the atmospheric pressure sensed by said pressure sensor is reduced more and more, and said opening degree rate of said through air passage by said through system opening/closing means is increased as the atmospheric temperature sensed by said temperature sensor is increased more and more.

4. The piston valve type carburetor as claimed in claim 1, wherein said opening/closing means is a solenoid valve of which driving is achieved in conformity with a fixed period.

5. The piston valve type carburetor as claimed in claim 1, wherein said opening/closing means is a solenoid valve of which driving is achieved in conformity with the period synchronized with an engine speed.

6. The piston valve type carburetor as claimed in claim 1, wherein said opening/closing means is a solenoid valve of which driving is normally achieved in conformity with a fixed period, and the fixed driving period is slightly elongated or shortened at the time of a certain specific engine speed.

7. The piston valve type carburetor as claimed in claim 1, wherein when said piston valve does not open said suction passage by a certain opening degree or more, said suction passage is not communicated with said negative pressure introduction passage.

8. A piston valve type carburetor including a float chamber having fuel stored therein, a piston valve adapted to be directly actuated to variably change a sectional area of a suction passage, and a jet needle secured to said piston valve to adjust a quantity of fuel to be ejected from said float chamber to said suction passage, comprising;

an atmospheric passage by way of which said float chamber is normally communicated with atmosphere, opening/closing means for opening or closing the intermediate part of said atmospheric passage, a negative pressure introduction passage of which one end is opened at the position of said suction passage or the position in the vicinity of said suction passage of which sectional area is varied by said piston valve and of which other end is opened at the position located above a fuel surface of said float chamber, a temperature sensor for sensing the temperature of atmosphere, a pressure sensor for sending the atmospheric pressure, and electronical controlling means for controlling opening or closing of said opening/closing means in response to informations from said temperature sensor and said pressure sensor.

9. The piston valve type carburetor as claimed in claim 8, wherein when it is assumed that the composite pressure composed of the atmospheric pressure introduced via said atmospheric passage opened or closed by said opening/closing means and the negative pressure of said suction passage introduced from said negative pressure introduction passage is represented as pressure in said float chamber, an opening rate of an atmospheric pressure introduction passage by said opening/closing means is reduced as the atmospheric pressure sensed by said pressure sensor is reduced more and more, and said opening degree rate of said atmospheric pressure introduction passage by said opening/closing means is reduced as the atmospheric temperature sensed by said temperature sensor is increased more and more.

10. The piston valve type carburetor as claimed in claim 8, wherein said piston valve type carburetor includes a through system air passage and through system opening/closing means for opening or closing the intermediate part of said through system air passage, and an opening degree rate of said through air passage by said through system opening/closing means is increased as the atmospheric pressure sensed by said pressure sensor is reduced more and more, and said opening degree rate of said through system air passage by said through system opening/closing means is increased as the atmospheric temperature sensed by said temperature sensor is increased more and more.

11. The piston valve type carburetor as claimed in claim 8, wherein said opening/closing meas is a solenoid valve of which driving is achieved in conformity with a fixed period.

12. The piston valve type carburetor as claimed in claim 8, wherein said opening/closing means is a solenoid valve of which driving is achieved in conformity with the period synchronized with an engine speed.

13. The piston valve type carburetor as claimed in claim 8, wherein said opening/closing means is a solenoid valve of which driving is normally achieved in conformity with a fixed period, and the fixed period is slightly elongated or shortened at the time of a certain specific engine speed.

14. The piston valve type carburetor as claimed in claim 8, wherein when said piston valve does not open said suction passage by a certain opening degree or more, said suction passage is not communicated with said negative pressure introduction passage.

* * * * *